United States Patent [19]

Davis

[11] 4,177,416

[45] Dec. 4, 1979

[54] MONOLITHIC CURRENT SUPPLIES HAVING HIGH OUTPUT IMPEDANCES

[75] Inventor: William F. Davis, Tempe, Ariz.

[73] Assignee: Motorola, Inc., Schaumburg, Ill.

[21] Appl. No.: 885,064

[22] Filed: Mar. 9, 1978

[51] Int. Cl.[2] ..... G05F 1/56

[52] U.S. Cl. ..... 323/4

[58] Field of Search ..... 307/296, 297; 323/1, 323/4; 330/288, 296, 297

[56] References Cited

U.S. PATENT DOCUMENTS

| | | | |
|---|---|---|---|
| 3,721,893 | 3/1973 | Davis | 323/4 |
| 3,942,129 | 3/1976 | Hall | 330/288 |
| 4,092,612 | 5/1978 | Schade | 323/4 X |

*Primary Examiner*—A. D. Pellinen

*Attorney, Agent, or Firm*—Maurice J. Jones, Jr.

[57] ABSTRACT

The current supply includes a constant current supply transistor which is cascoded with an output transistor. The current supply also has a feedback circuit including two current mirrors connected between the base and emitter electrodes of the output transistor. The feedback circuit and the output transistor clamps the potential at the collector electrode of the current supply transistor to a constant magnitude to substantially eliminate base width modulation therein. Also, the feedback circuit provides a current into the emitter of the output transistor having an instantaneous magnitude substantially equal to the magnitude of the base current flowing out of the base electrode of the output transistor. Consequently, the collector current of the output transistor remains substantially constant even though the variation of the magnitude of the load voltage at the output terminal of the current supply circuit causes the magnitude of the base current of the output transistor to change.

12 Claims, 1 Drawing Figure

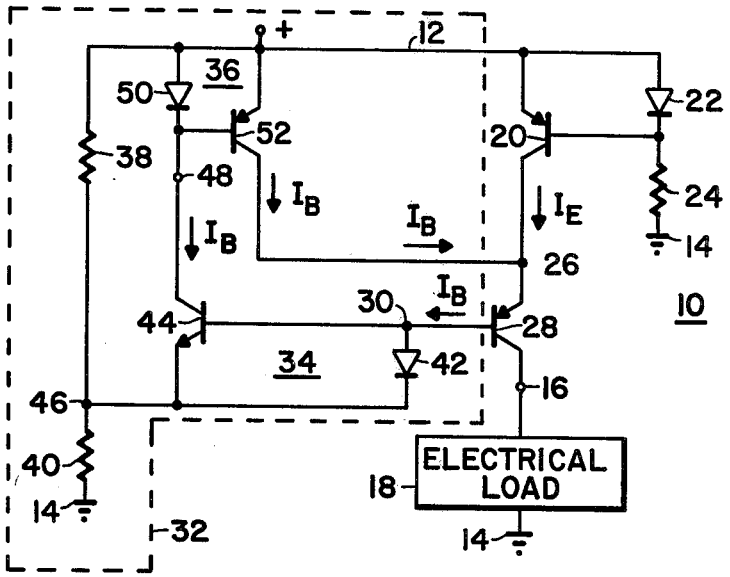
+
12
36
50
52
38
48
$I_B$
$I_B$
$I_B$
$I_E$
20
22
24
14
26
10
30
$I_B$
44
28
34
42
16
46
40
14
32
18
ELECTRICAL LOAD
14

MONOLITHIC CURRENT SUPPLIES HAVING HIGH OUTPUT IMPEDANCES

BACKGROUND OF THE INVENTION

Electronic circuits and particularly those fabricated in bipolar integrated circuit form often require a current supply or source capable of providing a current of substantially constant magnitude at an output terminal thereof even though the voltage at the output terminal is changed by the electrical load connected thereto. The output impedance of such a current source may be defined as the change in the magnitude of the voltage at the output terminal divided by the consequential change in the magnitude of the current supplied by the source. Ideally, if the output impedance of the current source was infinite, any change in the magnitude of the voltage at the output terminal would produce substantially no change in the magnitude of the current supplied to the output terminal. Prior art current sources suitable for fabrication in bipolar integrated circuits have finite output impedances.

One prior art current source configuration includes a series circuit connected between supply terminals which has a diode with one electrode connected at a junction to a resistor. A transistor has a base electrode connected to the junction and an emitter electrode connected to the same supply terminal which is connected to the other electrode of the diode. The collector electrode of the transistor is connected to the output terminal of the current supply.

The diode tends to clamp the base-to-emitter voltage of the transistor and to thereby provide a minority carrier density at the edge of the base of a fixed magnitude. As the collector-to-base junction voltage of the transistor changes in response to the magnitude of the voltage at the output terminal changing, then the width of the depletion spread about the collector-to-base junction changes or is modulated. This change in depletion spread produces variation in the effective width of the base region of the transistor. Consequently, the carrier gradient, which is the ratio or derivative of the minority carrier density to effective base width, in the base region changes. Since the magnitude of the collector current varies inversely with the effective width of the base region, the magnitude of the collector current changes with variation of the magnitude of the collector-to-base voltage. The base width modulation also affects the carrier recombination rate in the base region because the recombination rate is proportional to the base width. This change in recombination rate causes a generally undesirable change in the magnitude of the base current which changes the magnitude of the collector current of the transistor as a result of the change in the magnitude of the voltage at the output terminal of the current supply. Consequently, as the collector-to-base voltage is increased, for instance, the gradient is increased and the rate of recombination is decreased both of which tend to cause the magnitude of the collector current to undesirably increase and both of which thereby lower the output impedance of the supply.

An improved prior art current supply utilizes an additional transistor cascoded with the current supply transistor of the above described supply wherein the emitter electrode of the additional transistor is connected to the collector electrode of the current supply transistor. The base electrode of the additional transistor is connected to a terminal providing a reference potential. The collector electrode of the additional transistor is connected to the output terminal of the current supply.

The additional transistor tends to buffer or isolate the base-to-collector junction of the current supply transistor from changes in the magnitude of the voltage at the output terminal of the supply. Consequently, the current supply transistor provides a substantially constant emitter current to the additional transistor which tends to eliminate the change in the minority charge gradient in the base region of the additional transistor and the consequential effect thereof on the magnitude of the collector current. Thus, the improved current supply has a higher output impedance than the previously described current supply.

However, the recombination phenomenon still causes the base current of the additional transistor to change as the magnitude of the voltage across the collector-to-base junction of the additional transistor changes the base width thereof. The emitter current of a transistor is equal to the sum of the base and collector currents. Thus, since the magnitude of the emitter current is constant, as the magnitude of the base current decreases, the magnitude of collector current increases with increased collector-to-base voltage, for instance.

SUMMARY OF THE INVENTION

One object of the invention is to provide current supply circuits which have high output impedances.

Another object of the invention is to provide current source or supply circuits which compensate for or eliminate the effects of changes in the magnitude of the base current of output transistors so that the collector current thereof remains substantially constant.

Still another object of the invention is to provide a constant current supply circuit configuration which is particularly suitable for being provided in monolithic integrated circuit form and which provides a substantially constant current at an output terminal even though the magnitude of the voltage at the output terminal changes.

A further object of the invention is to provide current supply configurations which substantially reduces or eliminates the effects of base recombination and changes in minority gradients in bipolar transistors thereof which otherwise result from changes in the voltages applied to the collectors of such transistors.

The high output resistance or impedance current supply circuit of one embodiment has an output terminal for being coupled to an electrical load which provides an output potential of variable magnitude thereto. The current supply circuit further includes a first electron control device, a second electron control device and a feedback circuit. The input electrode of the second electron control device is coupled to the output electrode of the first electron control device and the output electrode of the second electron control device is coupled to the output terminal of the current supply circuit. The second electron control device provides and output current at the output electrode thereof and a control current at the control electrode thereof having magnitudes which tend to undesirably vary with the variations in the magnitude of the output potential. The feedback circuit is connected between the control and input electrodes of the second electron control device. The feedback circuit is responsive to the undesirable variations of the magnitude of the current at the control electrode of the second electron control device to provide a feedback current to the input electrode thereof for substantially eliminating the undesirable variations in the magnitude of the currents at the control and output electrodes of the second electron control device. Consequently, the magnitude of the output current provided at the output electrode of the second electron control device remains substantially constant even though the electrical load provides a voltage of variable magnitude to the output terminal of the high resistance current supply circuit.

BRIEF DESCRIPTION OF THE DRAWINGS

The sole FIGURE is a schematic diagram of a high output impedance current supply circuit configuration in accordance with the invention.

DETAILED DESCRIPTION OF THE PREFERRED EMBODIMENT

High output impedance current supply or source 10 of the FIGURE includes positive supply conductor or termianl 12 and negative or ground supply conductor or terminal 14. Output terminal 16 of circuit 10 is connected through electrical load 18 to negative supply conductor 14. One main function of circuit 10 is to provide a current having a constant magnitude to load 18 even though load 18 tends to cause the magnitude of the potential at terminal 16 to vary because of changes in the resistance of load 18, for instance.

PNP current source transistor 20 includes an emitter electrode connected to supply conductor 12, and a base electrode connected both to the cathode electrode of diode 22 and through resistor 24 to the negative supply conductor 14. The anode of diode 22 is connected to positive supply conductor 12. If circuit 10 is provided in monolithic form diode 22, as is the case with the other diodes of circuit 10, may either be a diode connected transistor or embodied in the same structure with transistor 20 in a known manner. Diode 22 and resistor 24 set up a bias potential of a substantially constant magnitude at the base electrode of transistor 20 which causes transistor 20 to supply a current having a substantially constant magnitude through the collector electrode thereof to node 26.

PNP output transistor 28 includes an emitter electrode connected to node 26, a collector electrode connected to output terminal 16 of the high impedance current source 10 and a base electrode connected to node 30. Transistors 20 and 28 are connected in a cascode configuration.

Feedback circuit 32 includes current mirrors 34 and 36 and a voltage divider comprised of series connected resistors 38 and 40. More specifically, current mirror 34 includes diode 42 and NPN trnasistor 44. Diode 42 has an anode electrode connected to terminal 30 and a cathode electrode connected to node 46 which is located between resistors 38 and 40. NPN transistor 44 has a base electrode connected to node 30, an emitter electrode connected to terminal 46 and a collector electrode connected to terminal 48. The junction of diode 42 and the base-to-emitter junction of transistor 44 are equal in area so that current mirror 34 responds to the base current, $I_B$ of transistor 28 to provide a first control signal current at terminal 48 having a magnitude substantially equal to $I_B$, as indicated on the drawing.

Current mirror 36 includes diode 50 and PNP transistor 52. The anode electrode of diode 50 is connected to positive supply conductor 12 and the cathode electrode of diode 50 is connected to terminal 48. PNP transistor 52 includes an emitter electrode connected to conductor 12, a base electrode connected to the cathode of diode 50 and a collector electrode connected to node or terminal 26. Thus, current mirror 36 responds to the first control signal, $I_B$ at terminal 48, to provide a second control signal to the emitter electrode of transistor 28 through terminal 26. This second control signal has the same magnitude as the base current, $I_B$ flowing into terminal 30 from transistor 28.

Since the magnitude of the voltage between conductors 12 and 14 is regulated, the potential at terminal 46 also has a constant magnitude. The voltage at the collector electrode of transistor 20 is equal to the base-to-emitter voltage of transistor 28 plus the junction voltage across diode 42 plus the potential at terminal 46, all of which are substantially constant in magnitude. Thus, the collector electrode of transistor 20 is clamped at a potential which is equal to two junction voltages above the fixed voltage level across resistor 40. The potential at the base electrode of transistor 20 is clamped to a substantially fixed magnitude of one junction voltage below the potential on conductor 12 by the junction voltage of diode 20. Thus, the collector-to-base junction voltage of current supply transistor 20 is clamped at a substantially constant magnitude. Therefore, the collector current of transistor 20 which is the emitter current of transistor 28 can be held to a substantially constant magnitude because transistor 20 does not experience base width modultion.

Since the emitter current of transistor 28 has a constant magnitude, the slope of the minority charge gradient in the base region of transistor 28 is held substantially constant even though the magnitude of the potential at terminal 16 varies because of changes in the resistance of electrical load 18. However, change in the magnitude of the potential at terminal 16 does result in base width modulation of transistor 28 is response to changes in the magnitude of the voltage across electrical load 18. More specifically, as the voltage across load 18 decreases the reverse bias across the collector-to-base junction of transistor 28 increases in magnitude thereby causing the depletion region to extend farther into the base of transistor 28. Consequently, less opportunity is provided for recombination in the base region of transistor 28 and the magnitude of the base current flowing out of the base of transistor 28 tends to decrease. Since the emitter current of transistor 28 is a constant, and the magnitude of the base current of transistor 28 decreases, then the magnitude of the collector current of transistor 28 must undesirably increase. However, as previously described, feedback circuit 32 delivers a current into the emitter electrode of transistor 28 which has an instantaneous magnitude that is substantially equal to the instantaneous magnitude of the base current flowing out of the base electrode of transistor 28. Thus, any changes in the magnitude of the base current, $I_B$ of transistor 28 caused by variation in the magnitude of the voltage at output terminal 16 by electrical load 18 are compensated for or eliminated by feedback circuit 32. Thus, the output current of current supply 10 tends to have a substantially constant magnitude even though the magnitude of the voltage at output terminal 16 varies and even though base width modulation tends to produce changes in base currents and changes in base minority charge gradients.

Thus what has been described is a current source or supply circuit 10 which has a high output impedance. Current feedback network 32 provides negative feedback which enables current source 10 to compensate for or eliminate the effects of the changes in magnitude of the base current of output transistor 28 so that the collector current thereof remains substantially constant. Furthermore, constant current supply circuit 10 has a configuration which it particularly suitable for being provided in monolithic integrated circuit form. Changes, such as substitution of complementary transistors and supply polarity reversal, can be made in the above described preferred embodiment by one skilled in the art without departing from the spirit and scope of the invention which is defined by the appended claims.

I claim:

1. A high resistance current supply circuit for providing a current having a substantially constant magnitude, the high resistance current supply circuit having an output terminal for being coupled to an electrical load, the electrical load providing a voltage of variable magnitude to the output terminal, the high resistance current supply circuit including in combination:

power supply conductor means;

electron control means having input, output and control electrodes, said output electrode of said electron control means being coupled to the output terminal of the high resistance current supply circuit, said electron control means tending to provide an output current at said output electrode thereof and a control current at said control electrode thereof having magnitudes which undesirably tend to correspond to variations in the magnitude of the voltage provided by the electrical load at the output terminal;

circuit means coupling said input electrode of said electron control means to said power supply conductor means; and feedback circuit means having input and output terminals, said input terminal being connected to said control electrode of said electron control means, said output terminal of said feedback means being connected to said input electrode of said electron control means, said feedback circuit means being responsive to said variations of the magnitude of said control current at said control electrode of said electron control means to provide a feedback current to said input electrode of said electron control means, said electron control means being responsive to said feedback current to substantially eliminate said undesirable variations in the magnitudes of said control current so that the magnitude of said output current provided at said output electrode of said electron control means remains substantially constant.

2. The high resistance current supply circuit of claim 1 wherein said circuit means includes additional electron control means.

3. The high resistance current supply circuit of claim 2 wherein said additional electron control means has input, output and control electrodes, said input electrode of said additional electron control means being connected to said power supply means and said output electrode of said additional electron control means being connected to said input electrode of said electron control means.

4. The high resistance current supply circuit of claim 3 further including bias circuit means connected to said control electrode of said additional electron control means to enable said additional electron control means to provide a current of substantially constant magnitude at said output electrode thereof.

5. The high resistance current supply circuit of claim 1 wherein said feedback circuit means further includes:

first current mirror means coupled to said control electrode of said electron control means for developing a first control current of substantially the same magnitude as said current at said control electrode of said electron control means; and second current mirror means connected between said first current mirror means and said input electrode of said electron control means for developing a second control current of substantially the same magnitude as the first control current, said second current mirror means applying said second control current to said input electrode of said electron control means so that the magnitude of said output current at said output electrode of said electron control means remains substantially constant even though the voltage at said output electrode has a varying magnitude.

6. The high resistance current supply circuit of claim 1 wherein said electron control means includes a bipolar transistor having emitter, base and collector electrodes respectively corresponding to said input, control and output electrodes thereof.

7. A high resistance current supply circuit having an output terminal for being coupled to an electrical load, the electrical load providing an output potential of variable magnitude to the output terminal, the high resistance current supply circuit including in combination:

power supply conductor means;

first electron control means having input, output and control electrodes, said input electrodes being coupled to said power supply conductor means;

second electron control means having input, output and control electrodes, said input electrode of said second electron control means being coupled to said output electrode of said first electron control means, said output electrode of said second electron control means being coupled to the output terminal of the high resistance current supply circuit, said second electron control means providing an output current to said output electrode thereof and a control current at said control electrode thereof having magnitudes which tend to undesirably vary with variations in the magnitude of the output potential; and feedback circuit means having input and output terminals, said input terminal being connected to said control electrode of said second electron control means, said output terminal being coupled to said input electrode of said second electron control means, said feedback circuit means being responsive to said variations of the magnitude of the current at said control electrode of said second electron control means to provide a feedback current to said input electrode of said second electron control means for substantially cancelling said undesirable variation in said magnitudes of said currents at the control and output electrodes of said second electron control means so that magnitude of the output current provided at said output electrode of said second electron control means remains substantially constant even though the electrical load provides a potential of variable magnitude to the output terminal of the high resistance current supply circuit.

8. The high resistance current supply circuit of claim 7 further including bias means coupled with said first electron control means for enabling said first electron control means to provide a current at said output electrode thereof having a constant magnitude.

9. The high resistance current supply circuit of claim 7 wherein:

said first electron control means includes transistor means having emitter, base and collector electrodes respectively corresponding to said input, control and output electrodes thereof; and said second electron control means includes second transistor means having emitter, base and collector electrodes respectively corresponding to said input, control and output electrodes thereof, said emitter electrode of said second transistor means being connected to said collector electrode of said first transistor means so that said first and second transistor means are connected in a cascode configuration.

10. The high resistance current supply circuit of claim 9 further including bias means coupled with said first transistor means for enabling said first transistor means to provide a current at said collector electrode thereof having a constant magnitude.

11. The high resistance current supply circuit of claim 10 wherein said feedback circuit means has a current mirror including:

third transistor means with emitter, base and collector electrodes;

diode means connected between said base and emitter electrodes of said third transistor means; and first reference supply conductor means connected to said emitter electrode of said third transistor means, said base-to-emitter junctions of said second and third transistor means being connected in series between said fixed reference supply conductor means and said collector electrode of said first transistor means to clamp said collector voltage of said first transistor means to a constant magnitude to substantially eliminate base width modulation in said first transistor means.

12. The high resistance current supply circuit of claim 11 wherein said feedback circuit means further includes an additional current mirror circuit connected between said first current mirror and said emitter electrode of said second transistor means, said first current mirror causing said base current of said second transistor means to appear at its output terminal to provide a first control signal, said second current mirror circuit responding to said first control signal to develop a second control signal having a magnitude substantially equal to the magnitude of the base current of said second transistor means, said second control signal being applied to said emitter electrode of said second transistor means to substantially cancel said base current variation of said second transistor means and to thereby substantially cancel the effects of any variation in said base current of said second transistor means due to variations in voltage at said collector electrode of said second transistor means caused by the electrical load.

* * * * *